US008715566B2

(12) United States Patent
Mueller

(10) Patent No.: US 8,715,566 B2
(45) Date of Patent: May 6, 2014

(54) METHOD AND INSTALLATION FOR THE DRY TRANSFORMATION OF A MATERIAL STRUCTURE OF SEMIFINISHED PRODUCTS

(75) Inventor: Bernhard Mueller, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 550 days.

(21) Appl. No.: 12/083,278

(22) PCT Filed: Sep. 25, 2006

(86) PCT No.: PCT/EP2006/066678
§ 371 (c)(1),
(2), (4) Date: Jul. 13, 2009

(87) PCT Pub. No.: WO2007/048664
PCT Pub. Date: May 3, 2007

(65) Prior Publication Data

US 2010/0001442 A1 Jan. 7, 2010

(30) Foreign Application Priority Data

Oct. 27, 2005 (DE) ..... 10 2005 051 420

(51) Int. Cl.
*C21D 1/62* (2006.01)

(52) U.S. Cl.
USPC ..... 266/252; 266/250

(58) Field of Classification Search
USPC ..... 266/249, 250, 252
See application file for complete search history.

(56) References Cited

U.S. PATENT DOCUMENTS

| | | | | |
|---|---|---|---|---|
| 3,957,111 | A * | 5/1976 | Kobayashi et al. | 266/251 |
| 4,009,872 | A | 3/1977 | McCoy | |
| 5,362,031 | A | 11/1994 | Heilmann | |
| 2009/0218738 | A1 * | 9/2009 | Schluck et al. | 266/259 |
| 2010/0001442 | A1 * | 1/2010 | Mueller | 266/46 |

FOREIGN PATENT DOCUMENTS

| | | |
|---|---|---|
| DE | 199 02 032 | 6/2000 |
| DE | 100 44 362 | 4/2002 |
| EP | 0 163 906 | 12/1985 |
| EP | 0 955 384 | 11/1999 |
| JP | 3-253512 | 11/1991 |
| JP | 8-35785 | 2/1996 |
| JP | 10-81913 | 3/1998 |
| JP | 2003-129127 | 5/2003 |
| RU | 2 232 363 | 7/2004 |

* cited by examiner

*Primary Examiner* — Scott Kastler
(74) *Attorney, Agent, or Firm* — Kenyon & Kenyon LLP

(57) ABSTRACT

An installation for the dry transformation of a material structure of semifinished products, particularly for dry bainitization, includes a quenching chamber and heating and/or cooling mechanism for setting the temperature prevailing on the inside of the quenching chamber, wherein the heating and/or cooling mechanism is developed as heating or cooling mechanism of a wall that borders on an inner chamber of the quenching chamber.

10 Claims, 2 Drawing Sheets

METHOD AND INSTALLATION FOR THE DRY TRANSFORMATION OF A MATERIAL STRUCTURE OF SEMIFINISHED PRODUCTS

BACKGROUND OF THE INVENTION

1. Field of the Invention

The present invention relates to a method and an installation for the dry transformation of a material structure of semifinished products.

2. Description of Related Art

For the improvement of material properties of metallic component parts, it is known that one may influence their material structure using heat treatment methods. Steels are particularly suitable for such treatment methods, in addition to a great multitude of metals, and of the steels, for instance, 100Cr6 reacts well to treatment using such bainitic structure tempering methods.

With regard to 100Cr6, heating of the material is first carried out to a temperature of approximately 850° C., for example, so that a so-called austenitic structure is formed in the material. Thereafter, the component parts thus heated have to be quenched very rapidly to the bainitic structure tempering temperature in their entire body temperature, that is, also on the inside of the component parts. A temperature range of ca. 220° C. is used for this, at which the so-called bainitic structure comes about. However, this temperature is only slightly above the so-called martensite start temperature, to which the work pieces absolutely must not cool off during the structural transformation process, since this would result in massive interference in the desired and particularly advantageous bainitic structure.

Other interferences in the formation of the bainitic structure may be brought on by cooling the component parts too slowly. In this connection, the pearlite structural region should particularly be mentioned. The pearlite structural region sets in approximately between 730° C. and 470° C. in response to a longer residence of the material in this temperature range. A further disturbance is represented by the so-called continuous bainitic range, whose upper temperature range overlaps with the lower temperature range for the formation of the pearlite structure. Its lower temperature range reaches down to the vicinity of the bainitizing range, depending on the residence duration of the material.

In order to avoid the formation of such undesired structures in the parts that are to be treated, a cooling time for the entire part, that is, both outside and inside in the core, of 35 seconds to 40 seconds is regarded as being necessary.

To overcome the disadvantages known from salt bath cooling methods that have been used up to now, such as harmfulness to the environment, purity problems in the salt bath, purity problems in the parts and cost intensity, so-called dry austempering methods have been developed. In these methods, the parts are quenched on the inside of a quenching chamber, using a temperature-controlled gas. To be able to dissipate the enormous energy liberated in this process, an appropriate gas flow is applied to the inside of the quenching chamber.

For the purpose of regulating the temperature of this gas stream, published German patent document DE 100 44 362 proposes, for instance, a variation of an effectively overflowed surface of a heat exchanger that cools the gas. In another method, an active control of the gas temperature is proposed, using two gas flow channels arranged in parallel, one channel being cooled and the other heated. The flow proportion of the hot and the cold channel is supposed to be appropriately adjusted via valves, in this instance, to regulate the gas temperature.

However, both these methods are encumbered by the problem that, depending on the response of the controlled system, the gas temperature oscillates about the setpoint temperature (bainitic structure tempering temperature), at least temporarily. Therefore, it may not be excluded that the gas temperature briefly falls below the martensite start temperature, and thereby at least endangers, if not even prevents, the structural development of bainite, for instance, in the component parts. This happens because the edge regions of a component part very rapidly take up the gas temperature, especially in thin-walled places, at corners or at courses of thread.

BRIEF SUMMARY OF THE INVENTION

An object of the present invention is to provide an improved method and an installation for the dry transformation of a material structure of semifinished parts.

Heating and/or cooling means of an installation for the dry transformation of a material structure of semifinished parts may be developed, according to the present invention, as heating or cooling means of a wall bordering on an inside chamber of a quenching chamber, so that the inside wall of the quenching chamber at least partially includes a heating and/or cooling surface. Thereby the temperature in the quenching chamber is able to be determined primarily and preponderantly by the temperature of the chamber wall bordering on the inner chamber.

In one example embodiment the quenching chamber is developed to be double-walled and filled with a heat exchange fluid. The heating of the inside of the quenching chamber, and also a possibly required cooling is thus able to be performed simply by influencing control on the temperature of the heat exchange fluid. For this, a control is particularly able to be provided which possibly takes into account still additional regulating parameters for keeping constant the temperature on the inside of the quenching chamber.

This procedure is based on the knowledge that the temperature of a sufficiently great mass is, at least for a limited time, easier to stabilize than a gas on the inside of the quenching chamber that is exposed during the quenching process to different temperature inputs or outputs that are independent of one another, or than a gas flow flowing through the quenching chamber. In this context, that time is regarded as a limited time which particularly is required for the quenching process and for the charging or discharging of the quenching chamber with the material that is to be quenched.

It was particularly recognized that the heat dissipation capability of so-called "cold quenching chambers" (which are quenching chambers at room temperature which are operated using a cooler in the form of an heat exchanger operated with cooling water) that had been used up to now in known devices, represents a control parameter which, based on its temperature, which is below the range to be regulated, is jointly responsible for the oscillation of the gas temperature during the quenching process.

By raising the temperature of the inner chamber of the quenching chamber from the room temperature surrounding the quenching chamber, that was usual up to now, to the desired quenching temperature that is to be controlled, it is true that the additional cooling effect during the quenching process, that was useful up to now, has been omitted. On the other hand, however, there is the enormous advantage that, by such an installation concept, falling below the gas temperature prevailing in the inside of the quenching chamber during the entire quenching process is reliably prevented. With that, it may be ensured that the temperature of the semifinished parts to be quenched is not able, during the quenching process, to fall off at any time down to the range of the martensite start temperature, and could consequently interfere with, or even prevent, the formation of the bainite structure.

What contributes particularly to this is that the heating and/or cooling means of the wall bordering on the inside of the quenching chamber, at least during the quenching process for the semifinished parts, apply to this wall at least approximately the temperature provided for the structural transformation.

For the better temperature stabilization of the gas effecting the quenching process on the inside of the quenching chamber, the installation may also include, in one specific embodiment, means for holding the temperature constant, especially in the quenching chamber.

A first means for holding constant the gas temperature is of course the wall bordering on the inside of the quenching chamber. This wall, both because of its mass and because of its applied temperature may already effect a first temperature stabilization. Furthermore, because of its good heat conducting properties, via which it dissipates the heat input, caused during the quenching process by the highly heated semifinished parts, from the inside of the quenching chamber to the outside, an additional temperature stabilization may be achieved.

In the next example embodiment, such means for holding constant the gas temperature on the inside of the quenching chamber may be a fluid by which the wall bordering on the inside of the quenching chamber is brought to a specified temperature. As the heating fluid or even heat exchange fluid one may use, for example, a heat transfer oil.

An increase in this effect may be achieved in a simple way by recirculating the heat exchange fluid, for instance, with the aid of a pump.

In one example embodiment, a gas stream flowing through the inside of the quenching chamber, for example, may be provided as additional means for holding constant the temperature. This also takes care of a rapid dissipation of the heat input from inside the quenching chamber, and of additional cooling of the semifinished parts that are to be quenched, by gas appropriately brought to a specified temperature that is surging after.

In an advantageous manner, this gas may itself, in turn, be influenced in its temperature by a heat exchange fluid. In this context, this gas flow may also be set to the temperature provided for the quenching process and applied to the inner wall of the quenching chamber. Thus, if necessary, using a heat exchange fluid and using a temperature control, both the wall of the quenching chamber and the temperature of the gas stream may be brought to a specified temperature.

For an additional, important improvement in the temperature stabilization, the installation may also include a cooling unit, in one particularly preferred specific embodiment. This may involve, for instance, a so-called regenerator which, as compared to the provided quenching temperature, is cooled using an energy content that is approximately equivalent to the energy content input into the quenching chamber by the charge of semifinished parts that are to be quenched. In order to be able to withdraw again the energy content input into the quenching chamber by the highly heated semifinished parts from the gas stream as fast as possible, the cooling unit may preferably also be situated in a manner that exposes it to the gas stream flowing through the quenching chamber.

In order to achieve as stable a quenching process as possible, the cooling unit may have such a regenerator mass and/or be made of such a material that, during the quenching process, a temperature equalization may take place of the comparatively lower temperature cooling unit with the temperature of the gas flowing through the quenching chamber, approximately at the same time as the temperature equalization between the semifinished parts brought to a higher specific temperature in the quenching chamber and this gas. It is especially regarded as advantageous, in this context, if the surface of the cooling unit is also developed in such a way that it supports the just described, e.g., approximately equally rapid equalization for the charge of the semifinished parts to be quenched and the cooling unit.

Large area surfaces are preferably suitable for this of thick-walled nests of tubes, possibly having additional cooling fins and/or cooling elements, made of a well conducting material such as copper.

DETAILED DESCRIPTION OF THE INVENTION

Figure 1:
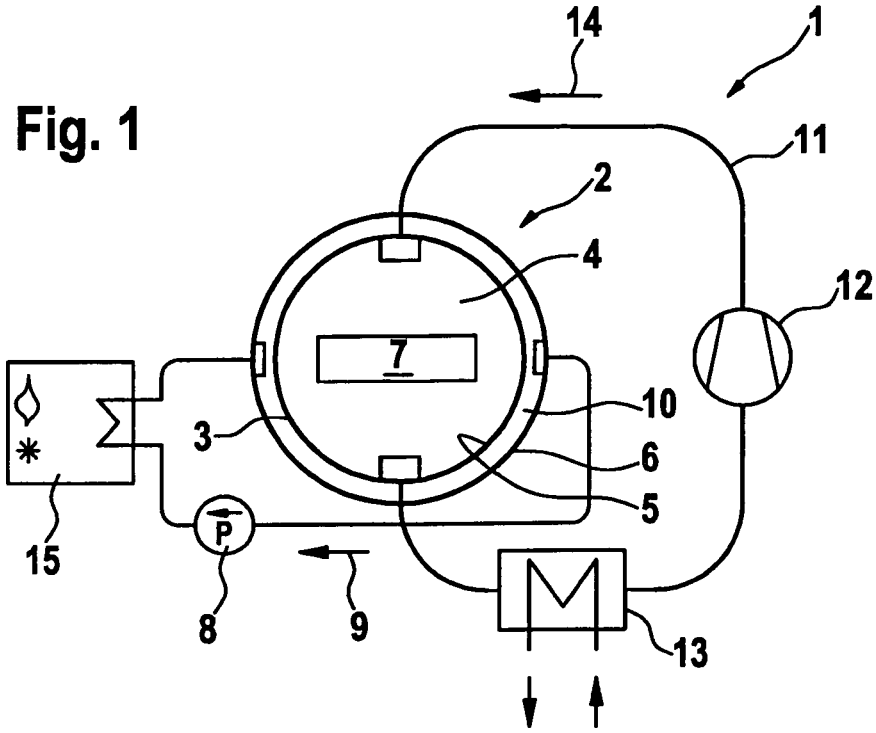
FIGS. 1 & 2 show a schematic representation of an installation for the dry transformation of a material structure of semifinished products.

FIG. 1 shows a schematic construction of an installation 1 for the dry transformation of a material structure of semifinished products using a quenching chamber 2. The core of double-walled quenching chamber 2 is its internal chamber 4, which is charged with a charge of semifinished products 7 that are to be quenched.

For setting the temperature of the gas which is located in inner chamber 4 of quenching chamber 2 and performs the quenching process of the semifinished product, between an inner wall 5 and an outer wall 6 of double-walled quenching chamber 2, a heat exchange fluid is provided as heating and/or cooling means 3.

For better temperature distribution and also for better absorption and release of heat, this heat exchange fluid 3 may have a fluid circulation imposed on it, and a pump 8 is particularly suitable for this, which is able to drive the fluid circulation, for instance, according to arrow direction 9.

Because of this circulation imposed on the heating and/or cooling means, wall 5, that borders on the inside chamber, is able to be evenly temperature adjusted and set to the temperature provided for the bainitic structure tempering. Together with this, however, the gas that is located in inner chamber 4 and that has the effect of the quenching process on the semifinished products is also set to this temperature.

Now, according to the present invention, the temperature of wall 5, that borders on inner chamber 4, is set exactly to this bainitic structure tempering temperature, so that it is reliably ensured that a semifinished product that is to be brought into inner chamber 4 and quenched does not fall below this temperature at any time, and with that, it is also ensured that no interference is possible in the material structural transformation because of falling below, for instance, the martensite start temperature.

The heating and/or cooling means of wall 5, that borders on inner chamber 4, are designed so that, at least during the quenching process of the semifinished products, they reliably maintain the temperature provided for the structural transformation.

In order to be able to ensure holding constant the temperature in inner chamber 4 of the quenching chamber, the installation may include further appropriate means. Such means for holding constant the temperature in inner chamber 4 may be, for example, wall 5 bordering on the inner chamber, a heat exchange fluid 3 that brings wall 5 to a specific temperature and a gas stream flowing through inner chamber 4, a heat exchange fluid bringing this gas stream to a specified temperature.

In the present example, such a gas stream may be applied to inner chamber 4 of quenching chamber 2 via gas line 11 using a blower situated in it. In this exemplary embodiment, number 13 designates the heat exchanger provided for holding constant the gas temperature, which is also situated in this gas circulation. An exemplary gas flow direction is symbolized by arrow 14.

In one example embodiment, fluid temperature adjusting gas flow heat exchanger 13 is also able to be serviced by a heating and/or cooling unit 15, which is already acting on heat exchange fluid 3 for bringing inner wall 5 of quenching chamber 2 to a specified temperature.

Figure 2:
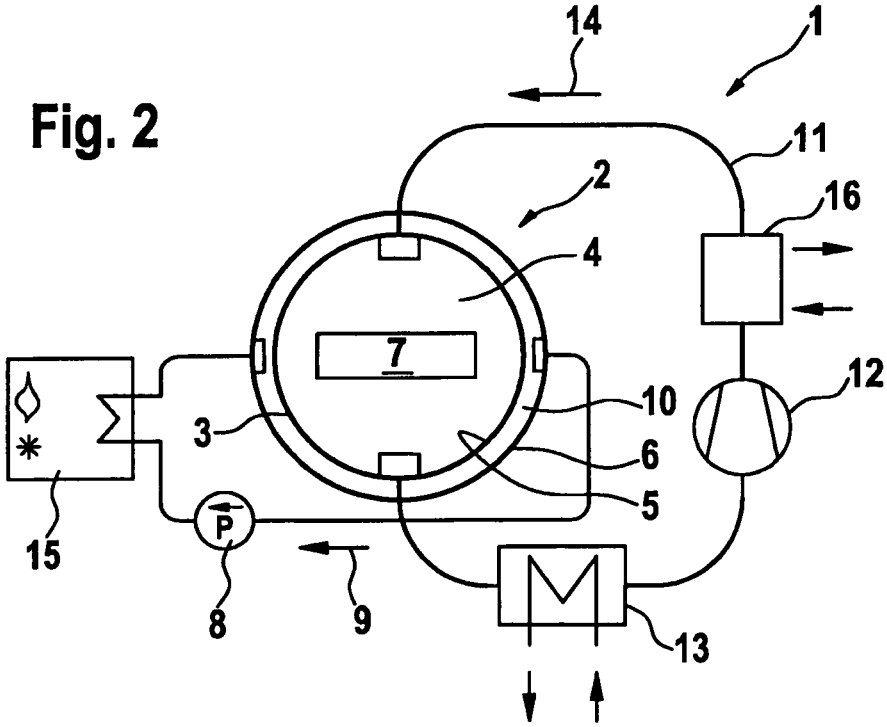

In one example embodiment modified compared to this, corresponding to FIG. 2, an additional cooling unit 16 may be provided, using the same construction otherwise, which is able rapidly to absorb the energy brought by the highly heated semifinished product into inner chamber 4. Because of that, the gas stream flowing through inner chamber 4 of quenching chamber 2 may be held essentially to the temperature provided for the bainitic structure tempering, even if there is a greater mass of inserted semifinished products. In this connection, it is particularly advantageous if this cooling unit 16 is inserted into the gas stream and overflowed by it, in such a way that a temperature equalization is made possible by the heat absorption from the gas flow heated by the charge.

Cooling element 16 cooled down by the quenching process to a so-called regenerating temperature is able to well absorb or compensate the heat given off by the charge during the quenching process, especially if the surface, the regenerator mass and the material are well developed for a rapid heat absorption from the gas flow. Well suitable for this are, for example, nests of tubes made of appropriately thick-walled copper, which have both rapid heat conduction and good regeneration mass. To increase the surface area, the tubes could even be designed to have ribs, in order to bring about an even more rapid temperature equalization.

Cooling unit 16 is preferably operated intermittently. It is possible, thereby, to cool off cooling unit 16 exactly by the amount of energy that is introduced by the subsequently introduced charge as excess energy and that has to be absorbed by it.

Figure 3:
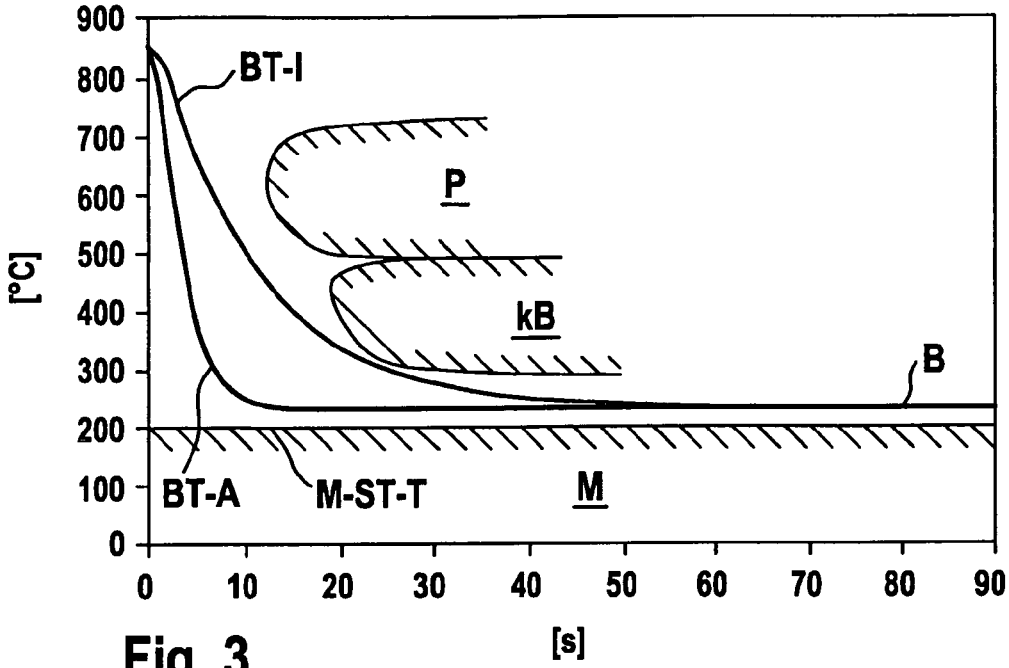
FIG. 3 shows a diagram having plotted on it temperature curves of the outer and the inner temperature of a semifinished product that is to be quenched, as well as three undesired microstructural regions in a time/temperature plot.

FIG. 3 shows a time/temperature diagram having a component part internal temperature curve (BT-I) and a component part external temperature curve (BT-A). These two temperature curves meet at approximately the range about 220° C., component part internal temperature (BT-I) running in such a way that it runs through neither pearlite range P nor the range for continuous bainite (kB). It may further be recognized from this that the component part temperature, that is, the temperature of the semifinished products, at no time drops below the bainitic structure tempering temperature of 220° C.

The temperature range about approximately 200° C. represents the martensite start temperature range (M-ST-T), below which, during the quenching process, the martensite structure, which interferes at least massively, even if not making it impossible, with the development of the desired bainitic material structure, develops in the semifinished products. The temperature scale extends in this diagram from 0 to 900° C., and the time scale from 0 to 90 seconds.

Figure 4:
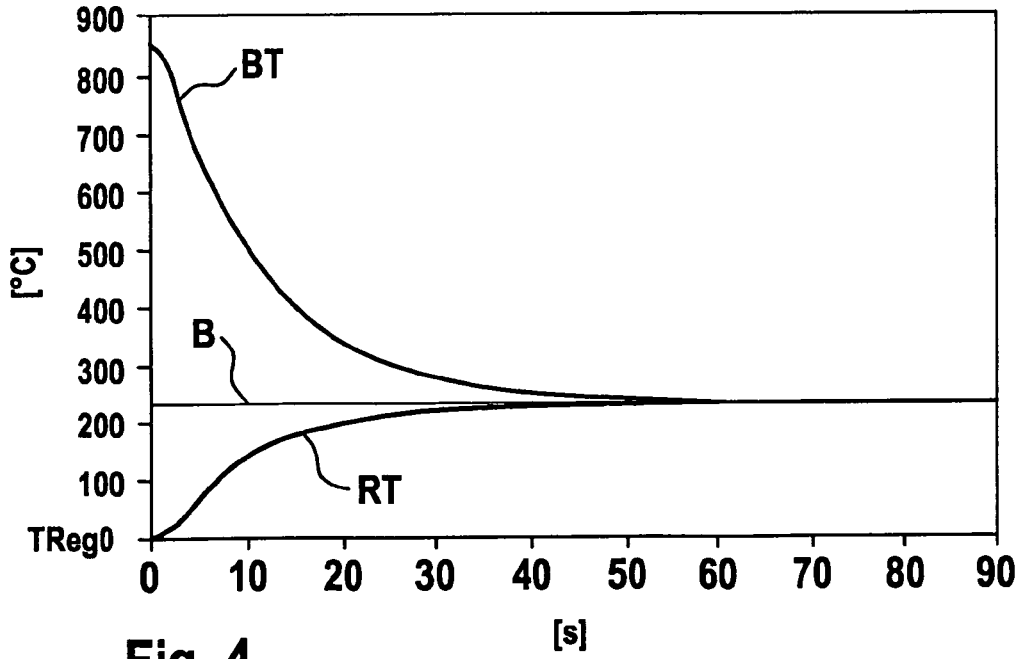
FIG. 4 shows an additional time/temperature plot having a product temperature curve shown in exemplary fashion, the temperature curve provided for the structural transformation and a temperature curve of a temperature stabilization element of the device.

In FIG. 4 we have plotted, over the same temperature/time scales, an average component part temperature (BT), the bainitizing temperature (B) and the temperature (RT) of the cooling unit, in this case called a regenerator. It may be seen from this that an equalization of component part temperature (BT) with the tempering temperature provided for the bainitic structure tempering of the semifinished product, in this case the bainitization temperature, proceeds approximately equally rapidly as the temperature equalization of pre-cooled cooling unit 16, again with this bainitic structure tempering temperature.

Furthermore, one may see that cooling unit 16 reaches the bainitization temperature slightly faster than the component parts, whereby it is again ensured that the component parts cannot be cooled off below the bainitization temperature.

What is claimed is:

1. An installation for dry transformation of a material structure of a semi-finished product, comprising:

a quenching chamber having an inner wall and an outer wall;

an arrangement configured for at least one of heating and cooling for setting the temperature prevailing inside of the quenching chamber by applying to at least a portion of the inner wall of the quenching chamber a temperature required for structural transformation of the semifinished product; and a temperature-stability arrangement configured for holding constant the temperature inside of the quenching chamber;

wherein the temperature-stability arrangement includes a heat-exchange fluid flowing between and directly contacting the inner wall and the outer wall of the quenching chamber and maintaining the inner wall of the quenching chamber at a specified temperature, the heat-exchange fluid not flowing into the inside of the quenching chamber, wherein the temperature-stability arrangement includes a gas stream flowing through the inside of the quenching chamber and configured for dissipation of heat input via a cooling unit from inside the quenching chamber, wherein the cooling unit includes a regenerator mass.

2. The installation as recited in claim 1, wherein the temperature-stability arrangement includes a heat-exchange fluid maintaining the gas stream flowing through the inside of the quenching chamber at a specified temperature.

3. The installation as recited in claim 1, wherein the cooling unit is situated exposed to the gas stream flowing through the inside of the quenching chamber.

4. The installation as recited in claim 1, wherein the cooling unit further includes a material such that, during the quenching process, two temperature equalizations take place at approximately the same time: a) a first temperature equalization in which a lower temperature of the cooling unit is raised to the temperature of the gas flowing through the quenching chamber; and b) a second temperature equalization in which a temperature of the semi-finished product is equalized to the temperature of the gas flowing through the quenching chamber.

5. The installation as recited in claim 1, wherein the surface of the cooling unit is configured in such a way that, during the quenching process, two temperature equalizations take place at approximately the same time: a) a first temperature equalization in which a lower temperature of the cooling unit is raised to the temperature of the gas flowing through the quenching chamber; and b) a second temperature equalization in which a temperature of the semi-finished product is equalized to the temperature of the gas flowing through the quenching chamber.

6. A method for dry transformation of a material structure of a semi-finished product, comprising:

providing an installation having a quenching chamber having an inner wall and an outer wall, and an arrangement configured for at least one of heating and cooling for setting the temperature prevailing inside of the quenching chamber;

adjusting a temperature of the inner wall of the quenching chamber facing the interior of the quenching chamber approximately to a temperature required for structural transformation of the semi-finished product during a quenching process for the semi-finished product; and holding constant the temperature inside of the quenching chamber by a temperature-stability arrangement;

wherein the temperature-stability arrangement includes a heat-exchange fluid flowing between and directly contacting the inner wall and the outer wall of the quenching chamber and maintaining the inner wall of the quenching chamber at a specified temperature, the heat-exchange fluid not flowing into the inside of the quenching chamber, wherein the temperature-stability arrangement includes a gas stream flowing through the inside of the quenching chamber and configured for dissipation of heat input via a cooling element from inside the quenching chamber, wherein the cooling element includes a regenerator mass.

7. The method as recited in claim 6, wherein the temperature of the inner wall of the quenching chamber facing the interior of the quenching chamber is held constant during the quenching process.

8. The method as recited in claim 7, wherein the gas stream flowing through the interior of the quenching chamber is provided at least during the quenching process, and wherein the temperature of the gas stream flowing through the quenching chamber during the quenching process is held constant to the temperature of the inner wall of the quenching chamber facing the interior of the quenching chamber.

9. The method as recited in claim 8, wherein the cooling element is situated in the path of the gas stream flowing through the quenching chamber at least during the quenching process, and wherein the temperature of the cooling element has a lower temperature compared to the temperature of the inner wall of the quenching chamber facing the interior of the quenching chamber.

10. The installation as recited in claim 1, wherein a cooling time of the semi-finished product is in the range of 35 to 40 seconds.

* * * * *

UNITED STATES PATENT AND TRADEMARK OFFICE

CERTIFICATE OF CORRECTION

PATENT NO. : 8,715,566 B2
APPLICATION NO. : 12/083278
DATED : May 6, 2014
INVENTOR(S) : Bernhard Mueller It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1116 days.

Signed and Sealed this
Twenty-ninth Day of September, 2015

Michelle K. Lee

Michelle K. Lee
*Director of the United States Patent and Trademark Office*